US006742214B2

(12) United States Patent
Lee

(10) Patent No.: US 6,742,214 B2
(45) Date of Patent: Jun. 1, 2004

(54) DE-DUSTING BRUSH STRUCTURE

(75) Inventor: Giovanni Lee, Chunghua Hsien (TW)

(73) Assignee: Chien-Chang Enterprise Co., Ltd., Chunghua Hsien (TW)

( * ) Notice: Subject to any disclaimer, the term of this patent is extended or adjusted under 35 U.S.C. 154(b) by 22 days.

(21) Appl. No.: 10/035,131

(22) Filed: Jan. 4, 2002

(65) Prior Publication Data

US 2003/0126706 A1 Jul. 10, 2003

(51) Int. Cl.[7] ..... A46B 3/00; A46B 7/00
(52) U.S. Cl. ..... 15/169; 15/184
(58) Field of Search ..... 15/169, 184

(56) References Cited

U.S. PATENT DOCUMENTS 1,538,220 A * 5/1925 Shultz
1,749,052 A * 3/1930 Watt
3,106,738 A * 10/1963 Bohne
3,193,863 A * 7/1965 Myers

* cited by examiner

*Primary Examiner*—Randall Chin
(74) *Attorney, Agent, or Firm*—Bacon & Thomas

(57) ABSTRACT

De-dusting brush structure including a patterned body, a connecting body, a brush body and an adjustment member. Two opposite sides of the connecting body are formed with ribs. An engaging flange is formed on lower end of the connecting body. The brush body is fixedly connected with the lower end face of the connecting body. The adjustment member is hollow and has a profile similar to that of the connecting body. An annular rib is formed on inner circumference of open end of the adjustment member. The adjustment member is fitted onto the connecting body and movable along the connecting body, whereby the annular rib of the adjustment member is up and down adjustably engaged with any of the ribs of the connecting body to locate the adjustment member. Accordingly, the volume of the brush body is adjustable and varied with the position of the adjustment member.

7 Claims, 3 Drawing Sheets

DE-DUSTING BRUSH STRUCTURE

BACKGROUND OF THE INVENTION

The present invention is related to a de-dusting brush structure having an adjustment member fitted onto a connecting body and movable along the connecting body. An annular rib of the adjustment member is up and down adjustably engaged with any of the ribs of the connecting body to locate the adjustment member so as to change the volume of the brush body. It is unnecessary for a user to press, hold or pinch the brush body when using the de-dusting brush to clean an object with differential face or depth.

FIG. 1 shows a conventional de-dusting brush including an outer casing 10, an inner casing 20 and a brush body 30. The outer casing 10 is an elongated elliptic body formed with a tunnel 11. A slide slot 12 is formed on the circumference of the outer casing 10. One end of the slide slot 12 is formed with a restricting hole 13. One end of the inner casing 20 is formed with three restricting plates 21 at equal intervals. A restricting key 22 is formed on upper face of free end of the upper restricting plate 21. The brush body 30 is fixed on one side of the inner casing 20.

The above conventional de-dusting brush has some shortcomings as follows:

1. The inner casing 20 can be moved to be located in the restricting hole 13. Under such circumstance, the brush body 30 is totally moved out of the outer casing 10 and exposed to outer side. However, when assembled, a user needs to press the restricting plate 21 and the restricting key 22 and simultaneously aim the restricting key 22 at the slide slot 12 of the outer casing 10. Accordingly, the pattern of the de-dusting brush is limited.

2. When assembled, a user needs to press the restricting plate 21 and the restricting key 22 and simultaneously aim the restricting key 22 at the slide slot 12 of the outer casing 10. It is inconvenient for the user to perform such operation.

3. The brush body 30 is totally exposed to outer side or totally hidden. Therefore, it is impossible to vary the size of the brush body 30 to clean a differential face or depth.

4. When cleaning a differential face or depth, a user needs to hold or pinch the brush body 30 with a hand to reduce the volume thereof. Therefore, it is inconvenient to clean the differential face with such de-dusting brush.

5. When the restricting key 22 is located in the restricting hole 13, a gap still exists so that the brush body will swing. This makes it inconvenient to clean a face with such de-dusting brush.

SUMMARY OF THE INVENTION

It is therefore a primary object of the present invention to provide a de-dusting brush structure having an adjustment member which is directly fitted onto a connecting body and movable along the connecting body. An annular rib of the adjustment member is up and down adjustably engaged with any of the ribs of the connecting body to locate the adjustment member so as to change the volume of the brush body.

It is a further object of the present invention to provide the above de-dusting brush structure with which a user can conveniently clean an object with differential face or depth without pressing, holding or pinching the brush body. When assembled, it is unnecessary for the user to aim the adjustment member at the connecting body so that the pattern of the de-dusting brush is not limited. The ribs of the connecting body serve to firmly restrict and locate the annular rib of the adjustment member without swinging or dropping during cleaning operation.

The present invention can be best understood through the following description and accompanying drawings wherein:

DETAILED DESCRIPTION OF THE PREFERRED EMBODIMENTS

Figure 1:
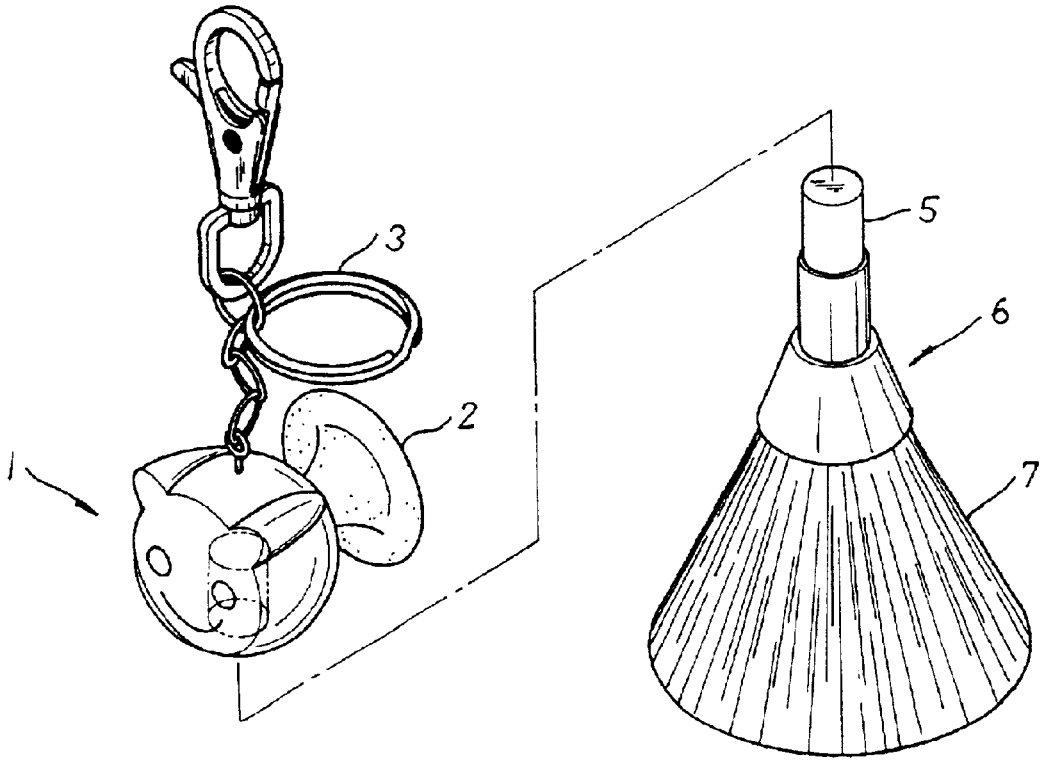
FIG. 1 PRIOR ART
FIG. 1 is a perspective exploded view of a conventional de-dusting brush.
Figure 2:
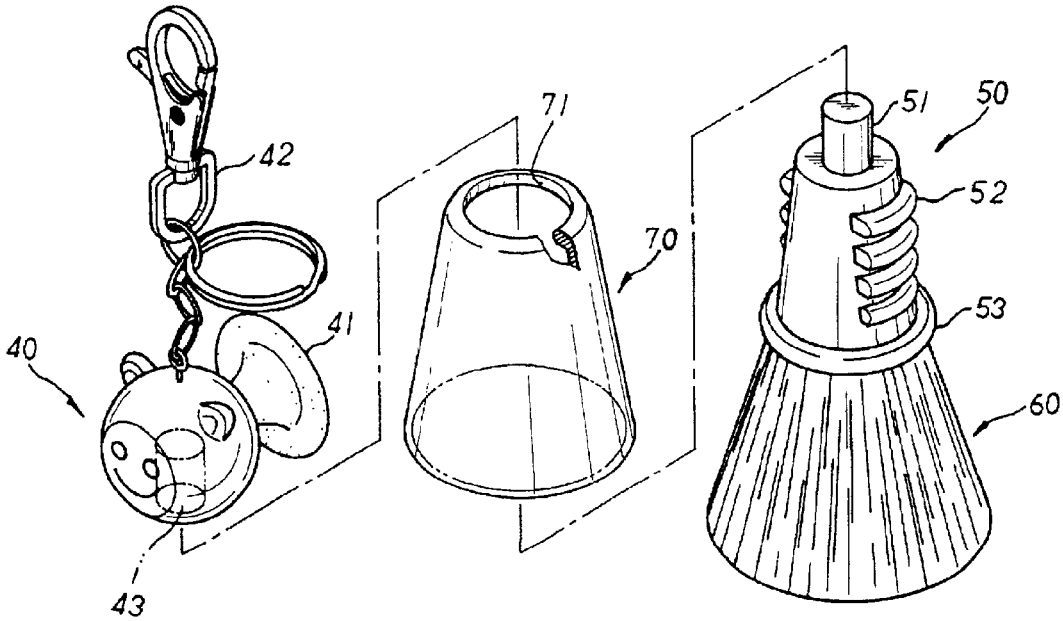
FIG. 2 is a perspective exploded view of the de-dusting brush of the present invention.

Please refer to FIG. 2. The de-dusting brush structure of the present invention includes a patterned body 40, a connecting body 50, a brush body 60 and an adjustment member 70. The patterned body 40 can have any pattern. A sucker 41 is disposed on one side of the patterned body 40 and a key ring 42 is fixed at upper end of the patterned body 40. A locking hole 43 is formed on lower end of the patterned body 40. The connecting body 50 is a conic body. A locking post 51 projects from upper end thereof in cooperation with the locking hole 43 of the patterned body 40. Two opposite sides of the connecting body 50 are formed with ribs 52 arranged from upper side to lower side at equal intervals. The heights of the ribs 52 are gradually reduced from upper side to lower side. An engaging flange 53 is formed on lower end of the connecting body 50. The engaging flange 53 has a height higher than any of the ribs 52. The brush body 60 is fixedly connected with the lower end face of the connecting body 50. The adjustment member 70 is made of plastic material and softer than the connecting body 50. The adjustment member 70 has a profile similar to that of the connecting body 50 and is hollow. The inner diameter of the adjustment member 70 is slightly larger than the outer diameter of the corresponding section of the connecting body 50. An annular rib 71 is formed on inner circumference of open end of the adjustment member 70.

Figure 3:
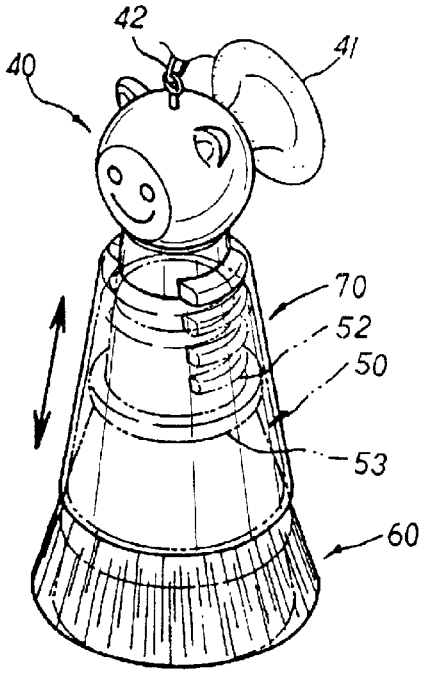
FIG. 3 is a perspective assembled view of the de-dusting brush of the present invention, showing the operation thereof.

When assembled, as shown in FIG. 3, the brush body 60 is first fixedly connected with lower end of the connecting body 50. Then the adjustment body 70 is fitted onto the connecting body 50 from upper side with the annular rib 71 engaged with the ribs 52 of the connecting body 50. Then the locking post 51 of the connecting body 50 is fixedly adhered to or locked in the locking hole 43 of the patterned body 40 to complete the assembly.

Figure 4:
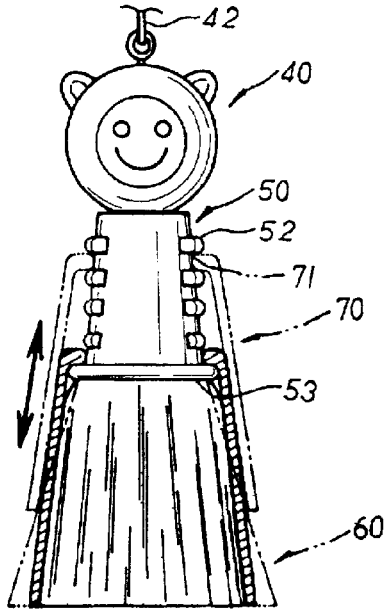
FIG. 4 is a sectional assembled view of the de-dusting brush of the present invention, showing the operation thereof.

Referring to FIG. 4 which shows the operation of the present invention, when using the de-dusting brush, as necessary, the annular rib 71 of the adjustment member 70 can be up and down adjustably engaged with any of the ribs 52 of the connecting body 50. Accordingly, the volume of the brush body 60 is varied with the position of the adjustment member 70, whereby a user can conveniently use the de-dusting brush to clean up an object with differential face or depth. It is no more necessary for the user to press, hold or pinch the brush body 60 when cleaning the object. In addition, the upper and lower ribs 52 of the connecting body 50 serve to firmly restrict and locate the annular rib 71 of the adjustment member 70 without swinging or dropping during cleaning operation. When not used, the adjustment member 70 is moved downward to engage the annular rib 71 thereof with the engaging flange 53 of the connecting body 50. Under such circumstance, the brush body 60 is totally hidden in the adjustment member 70. The de-dusting brush can be hung on or attached to a certain place by means of the key ring 42 or the sucker 41.

Figure 5:
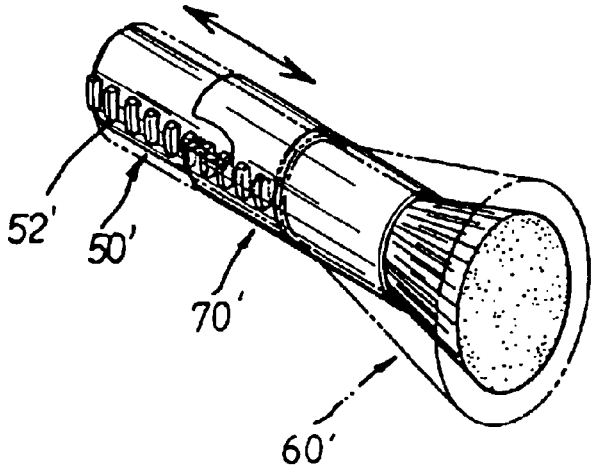
FIG. 5 is a perspective assembled view of another embodiment of the de-dusting brush of the present invention, showing the operation thereof.

FIG. 5 shows another embodiment of the present invention, which includes a connecting body 50', a brush body 60' and an adjustment member 70'. The connecting body 50' is a rectangular body. Two opposite sides of the connecting body 50' are formed with ribs 52' arranged from upper side to lower side at equal intervals. The heights of the ribs 52' are equal to each other. An engaging flange 53' is formed on lower end of the connecting body 50'. The engaging flange 53' has a height higher than any of the ribs 52'. The brush body 60' is fixedly connected with the lower end face of the engaging flange 53' of the connecting body 50'. The adjustment member 70' is made of plastic material and softer than the connecting body 50'. The adjustment member 70' has a profile similar to that of the connecting body 50' and is hollow. The inner diameter of the adjustment member 70' is slightly larger than the outer diameter of the corresponding section of the connecting body 50'. An annular rib 71' is formed on inner circumference of open end of the adjustment member 70'.

When assembled, the brush body 60' is first fixedly connected with lower end of the connecting body 50'. Then the adjustment body 70' is fitted onto the connecting body 50' from upper side with the annular rib 71' engaged with the ribs 52' of the connecting body 50' to complete the assembly.

Figure 6:
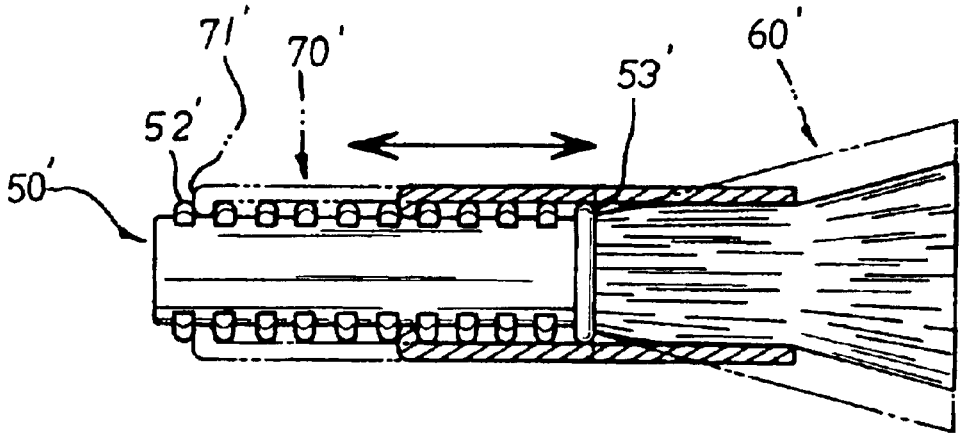
FIG. 6 is a sectional assembled view of the de-dusting brush of FIG. 5, showing the operation thereof.

Referring to FIG. 6 which shows the operation of the above embodiment of the present invention, when using the de-dusting brush, as necessary, the annular rib 71' of the adjustment member 70' can be up and down adjustably engaged with any of the ribs 52' of the connecting body 50'. Accordingly, the volume of the brush body 60' is varied with the position of the adjustment member 70', whereby a user can conveniently use the de-dusting brush to clean up an object with differential face or depth. It is unnecessary for the user to press, hold or pinch the brush body 60' when cleaning the object. In addition, the upper and lower ribs 52' of the connecting body 50' serve to firmly restrict and locate the annular rib 71' of the adjustment member 70' without swinging or dropping during cleaning operation. When not used, the adjustment member 70' is moved downward to engage the annular rib 71' thereof with the engaging flange 53' of the connecting body 50'. Under such circumstance, the brush body 60' is totally hidden in the adjustment member 70'.

The above embodiments are only used to illustrate the present invention, not intended to limit the scope thereof. Many modifications of the above embodiments can be made without departing from the spirit of the present invention.

What is claimed is:

1. De-dusting brush structure comprising a connecting body, a brush body fixedly connected with one end of the connecting body and a hollow adjustment member, the adjustment member having a profile similar to that of the connecting body, an inner diameter of the adjustment member being slightly larger than the outer diameter of the corresponding section of the connecting body, the adjustment member being fitted onto the connecting body to form an adjustable de-dusting brush, said de-dusting brush structure being characterized in that two opposite sides of the outer face of the connecting body are formed with ribs arranged from one end to the other end at equal intervals, an engaging flange being formed on outer circumference of the other end of the connecting body, an annular rib being formed on inner circumference of one end of the adjustment member, whereby after fitted onto the connecting body, the adjustment member is adjustably movable along the outer face of the connecting body and locatable without detaching from the connecting body.

2. De-dusting brush structure as claimed in claim 1, wherein the connecting body is a conic body and the heights of the ribs are gradually reduced from one end to the other end.

3. De-dusting brush structure as claimed in claim 1, wherein the connecting body is a rectangular body and the heights of the ribs are equal to each other.

4. De-dusting brush structure as claimed in claim 1, wherein the engaging flange of the connecting body has a height higher than any of the ribs for stopping the adjustment member from detaching from the connecting body.

5. De-dusting brush structure as claimed in claim 1, wherein the adjustment member is made of plastic material and softer than the connecting body.

6. De-dusting brush structure as claimed in claim 1 or 5, wherein the annular rib of the adjustment member is movable along the connecting body and firmly locatable between two ribs of the connecting body, whereby the brush body will not swing during cleaning operation.

7. De-dusting brush structure as claimed in claim 1 or 2, wherein the connecting body is a conic body and a locking post is formed at one end thereof for locking in a locking hole of a patterned body, a sucker being disposed on one side of the patterned body, a key ring being connected with an upper end of the patterned body to form a multifunctional de-dusting brush.

* * * * *